United States Patent [19]

Reilly, Jr. et al.

[11] 4,310,103

[45] Jan. 12, 1982

[54] MEDICATION DISPENSER

[76] Inventors: Philip C. Reilly, Jr., 255 Hill St., Whitinsville, Mass. 01588; Charles D. Battersby, Rawson Heights, Webster, Mass. 01570

[21] Appl. No.: 148,207

[22] Filed: May 9, 1980

[51] Int. Cl.[3] ..... B65B 59/00

[52] U.S. Cl. ..... 221/15; 221/76

[58] Field of Search ..... 221/76, 15, 79, 80, 221/81, 82–88

[56] References Cited

U.S. PATENT DOCUMENTS 1,116,599 11/1914 Madson ..... 221/76 X 1,641,860 9/1927 Morell ..... 221/76

3,815,780 6/1974 Bauer ..... 221/15

4,207,992 6/1980 Brown ..... 221/15

*Primary Examiner*—Allen N. Knowles

[57] ABSTRACT

An automatic medication dispenser is disclosed which dispenses medication serially at preselected time intervals. The medication may be retrieved by the patient within a grace period after which time the medication returns to an inaccessible location within the device. The apparatus includes an endless chain of containers holding prepackaged medications which are moved sequentially under the control of a programmable timer from within the device to a presentation position accessible to the patient.

3 Claims, 5 Drawing Figures

MEDICATION DISPENSER

BACKGROUND OF THE INVENTION

This invention relates to dispensers and more particularly to automatic dispensers for dispensing preloaded, sealed medication packages.

A dispensing apparatus capable of presenting serially the proper medication dosages at preselected times of day has many advantages over traditional methods of dispensing medication. Such a dispenser is particularly well suited to the needs of chronic medication users, e.g., the elderly, both at home or in an institutional environment. The automatic dispensing of medication at the appropriate times during the day will, to a large extent, eliminate forgotten dosages and will reduce confusion as to whether a particular dosage was taken or not. In addition, such an apparatus which dispenses only the medication to be taken at a particular time reduces the likelihood that errors will be made in the medication taken and will make overdoses more difficult. Such a device does away with the necessity of medication bottles and their clumsy safety caps which the elderly, in particular, have trouble opening if they are able to open the bottle at all. An automatic dispenser will be at least as safe as safety bottles since only a single dose is dispensed at a time, the remaining medication being held securely within the apparatus. In addition, an automatic medication dispenser offers considerable cost savings by eliminating personnel otherwise necessary to measure out and dispense medications. For example, in an institutional setting such as a hospital or nursing home a single person can preload the dispensers necessary for an entire ward for a week or more.

An automatic dispenser which allows the patient access to the medication only for a limited period after it first becomes available insures that the medication will be taken at the correct time or not at all. Because noncompliance with doctors' orders and patients' inadvertent errors are prevalent problems, a dispenser which recaptures any unused medication is extremely useful for later verification of compliance. That is, a device which permits the patient to retrieve the medication for a limited period only and then recaptures the medication permits a nurse, doctor or other responsible person later to verify that certain doses were taken on schedule, and that other doses were skipped.

The recapture aspect of an automatic medication dispenser is also invaluable for performing pharmaceutical research protocols in which the weight accorded a study depends critically on verification of compliance with the specified dosage schedule. In such a case, the experimenters can determine quickly and positively whether the protocol was correctly followed. In addition, an automatic device will be a very useful tool for studying the whole area of patient compliance with prescribed dose administration regimens. Currently, there are no generally accepted standardized procedures for making such an assessment of rates of patient compliance. The recapture feature in an automatic medication dispenser is also very useful when the automatic dispenser is used to dispense a diagnostic kit for use by the patient. For example, a patient might be required to test his urine by immersing in it a chemically treated probe. After this has been done, the patient replaces the probe into the device which will store it for later analysis by a nurse or physician.

An apparatus which dispenses preloaded, sealed packages of medication rather than tablets and capsules in loose form has several advantages. First of all, a wide variety of medications can be dispensed together without the attendant risk that some or all of such medications will become stuck within the device thereby causing a missed or incorrect dosage. Second, the use of preloaded packages will improve patient compliance because the patient must remove the package, empty it, and then replace the emptied package. The patient's having to replace an emptied package will serve as a positive reminder that failure to take the dosage will be discovered at a later time and will thus promote patient compliance. Dispensing the medication in envelopes will also allow specific instructions to accompany the medication. For example, the envelope might contain a warning to discontinue a particular medication upon the occurrence of specified side effects.

Automatic medication dispensers with timers are known, e.g., for dispensing tablets or capsules, such as contraceptive tablets. These devices, however, cannot dispense different groups of medication at different times—for example, a mixture of both tablets and capsules. Other dispensers are also known for dispensing at preselected times preloaded containers holding the medication to be taken at a particular time. These devices, however, do not have the recapture feature essential for compliance verification.

An object of this invention, therefore, is a dispenser which dispenses at the appropriate times the medication to be taken at a particular time and which recaptures any medication that has not been retrieved within an adjustable grace period.

Yet another object of this invention is such an automatic medication dispensing apparatus which is simple, reliable and inexpensive to manufacture and use.

Still another object of the invention is such a dispenser which can be used not only for dispensing tablets, capsules, topical ointments and other medication along with any special instructions but also for dispensing and subsequent storing of self diagnostic test kits.

Other objects and advantages of the invention disclosed herein will be in part particularly pointed out and in part apparent in what follows.

SUMMARY OF THE INVENTION

The medication dispenser for presenting consecutively each of a plurality of containers includes containers linked together to form an endless chain. Stepping apparatus including a programmable timer is provided for moving the chain intermittently to advance the containers successively to and from a fixed presentation position. A housing completely encloses all of the containers except for a container in the presentation position. The housing has exit and entrance openings adjacent the presentation position and the containers are adapted to close substantially the exit and entrance openings after a container has advanced to and from the presentation position. The containers preferably have a pair of opposite walls of congruent peripheral outline to effect the closing of the exit and entrance openings.

In a preferred embodiment the stepping apparatus such as a solenoid activated ratchet mechanism advances the containers at the end of consecutive alternating first and second time intervals. The containers and openings are spaced and dimensioned so that during each first interval a container is located in the presentation position and during each second time interval no container is located in the presentation position. The first and second time intervals may be of unequal length and are independently adjustable.

The chain of containers is supported by a pair of spaced apart, rotatable, parallel posts so that the chain assumes the form of an elongate loop with two substantially straight parallel sides. The containers are disposed in side by side abutting relation along the parallel sides. The presentation position lies substantially in the plane which includes the pair of posts and the exit and entrance openings lie in planes transverse to the plane defined by the pair of posts. In another embodiment, the exit and entrance openings lie in mutually perpendicular planes, each plane intersecting the plane defined by the posts at forty-five degrees.

These embodiments preferably include apparatus for audibly or visibly signaling the advancement of the containers. In addition, a locking mechanism is provided to prevent advancement of the containers except upon activation of the stepping apparatus.

BRIEF DESCRIPTION OF THE DRAWING

The invention disclosed herein will be understood better with reference to the following drawing in which.

DESCRIPTION OF THE PREFERRED EMBODIMENTS

Figure 2:
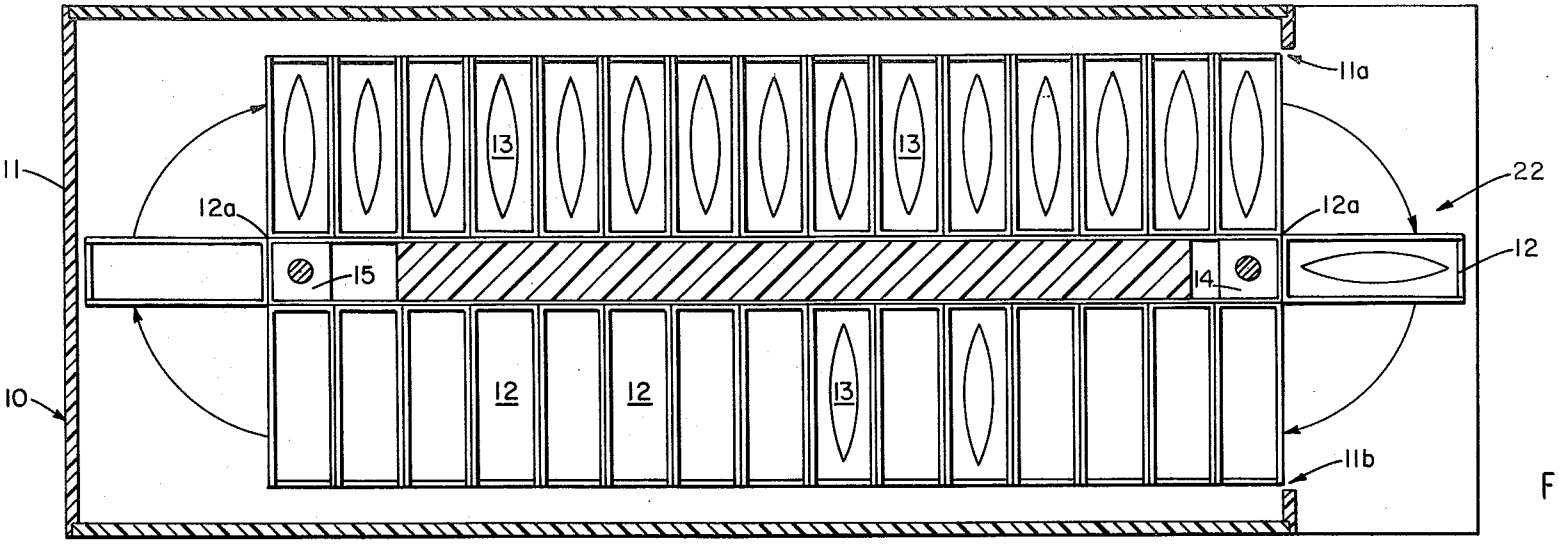
FIG. 2 is a view along section lines 2—2 of the embodiment of FIG. 1.
Figure 1:
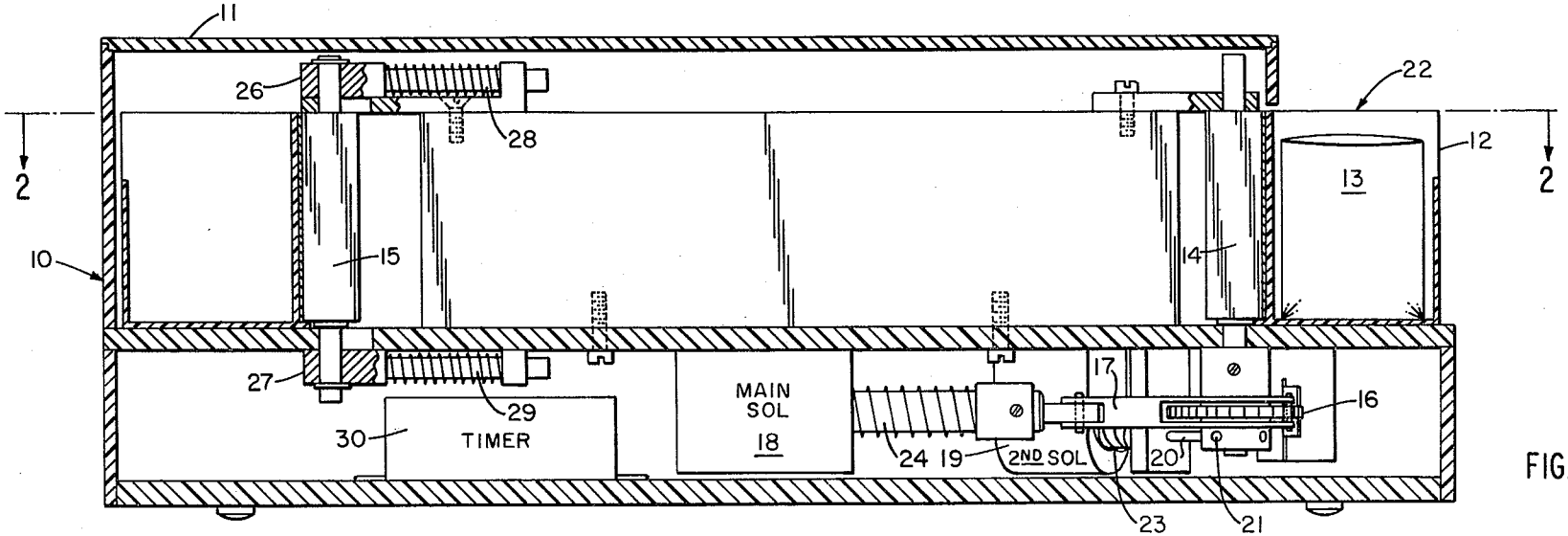
FIG. 1 is a side elevation view of one embodiment of the invention.
Figure 1A:
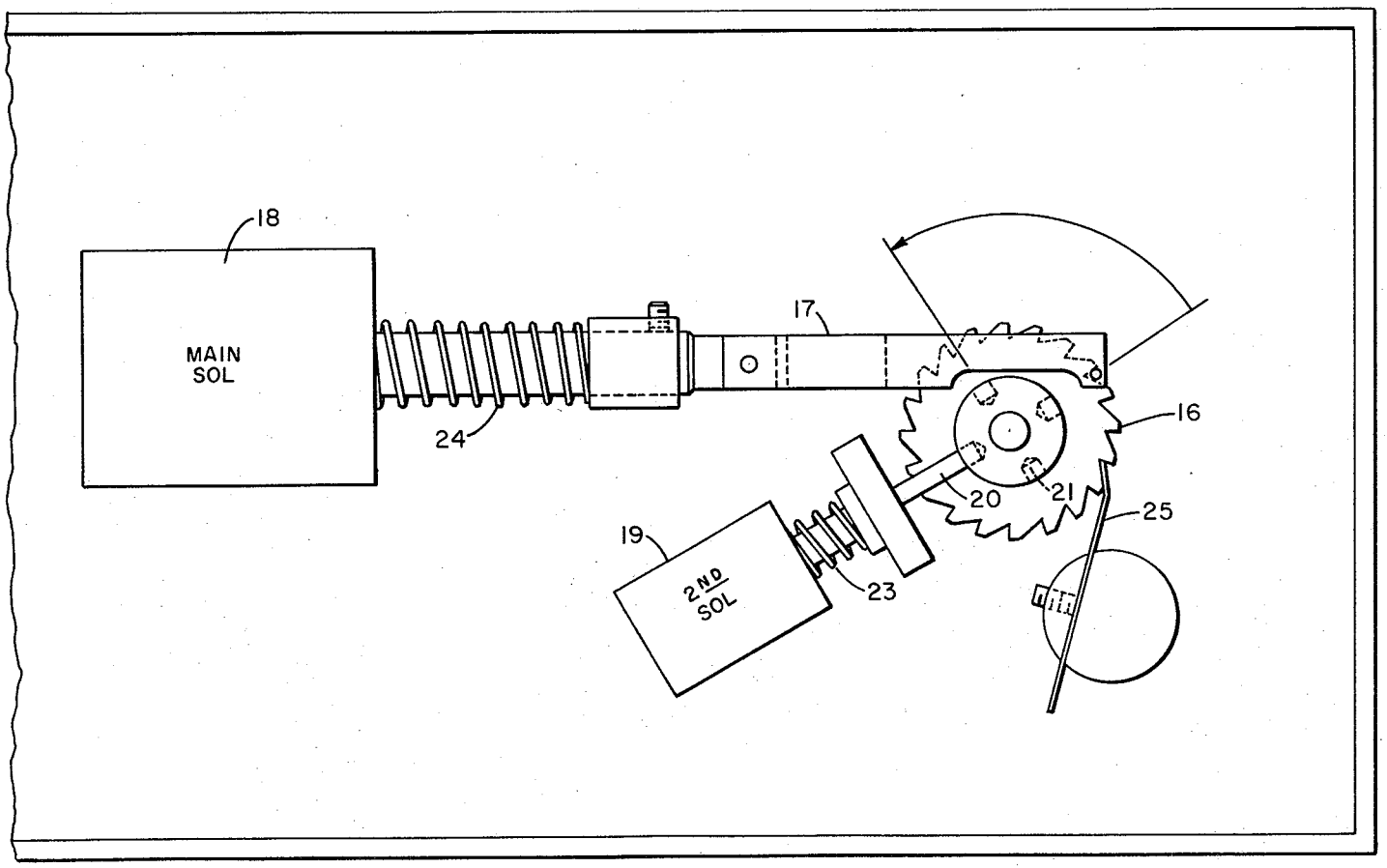
FIG. 1*a* is a partial bottom view of the embodiment of FIG. 1.

Referring first to FIGS. 1, 1*a* and 2, the medication dispenser is generally designated at 10. A housing 11 encloses a plurality of containers 12 adapted for holding individual medication containing envelopes 13. These envelopes 13 are individually preloaded with the medications which a patient must take at prescribed intervals. Although the envelopes 13 may be of any convenient form, it is preferred that they contain a transparent window portion so that the contents may be checked visually. In addition, it is preferred that the envelopes 13 have a space for special instructions and for the patient to make notes on the envelope after taking the medication. Such an envelope is then replaced in the dispensing container for evaluation later by a nurse or physician. The containers 12 are essentially rectangular parallelepipeds made of any convenient material such as hard plastic. The containers 12 are linked to one another at their inner sides to form an endless chain by a band 12*a* of flexible material such as plastic.

Referring now specifically to FIGS. 1 and 1*a* the endless chain of containers 12 is disposed around two spaced apart, square rotatable posts 14 and 15 so that the endless chain takes on the shape of an elongate loop. It is noted that the chain of containers 12 may have other convenient shapes such as a circle. The dimension of a face of the posts 14 and 15 equals the narrow dimension of the containers 12. The post 14 is mounted in conventional bearings and terminates at its lower portion in a ratchet wheel 16. The ratchet wheel 16 is adapted to be engaged by a ratchet pawl assembly 17 which is attached to the linearly acting main solenoid 18. A second linearly acting solenoid 19 is provided for locking the post 14 to insure that the containers 12 are not moved in an unauthorized manner. The solenoid 19 terminates in a pin 20 which is adapted to fit within holes 21 spaced 90° apart around the periphery of the lower portion of the post 14. The main solenoid 18 and the locking solenoid 19 are adapted to be activated and deactivated together and are energized by ordinary alternating current or by self-contained batteries. When the solenoids 18 and 19 are activated, the pin 20 is withdrawn from a hole 21 thereby freeing the post 14 for rotation. The activation of the solenoid 18 pulls the ratchet pawl assembly 17 toward the solenoid 18 causing the ratchet wheel 16 and the post 14 to which it is rigidly attached to rotate. In this embodiment the ratchet wheel 16 will rotate 90° so that a container 12 is moved from an exit opening 11*a* in the housing 11 to a presentation position indicated generally at 22 outside of the housing. As part of this same motion another container 12, which had been in the presentation position 22, is moved to an entrance opening 11*b* within the housing 11. After such a rotation, both solenoids 18 and 19 are simultaneously deactivated. Upon deactivation, a spring 23 causes the pin 20 to engage a hole 21, and a spring 24 returns the ratchet pawl assembly 17 to its initial position. A catch spring 25 adapted for engagement with the ratchet wheel 16 is provided for insuring stable and smooth rotation of the ratchet wheel 16 in a single direction.

The rotatable square post 15 is mounted within bearings 26 and 27. The bearings 26 and 27 are themselves mounted for limited linear movement along the axis of the dispenser. Springs 28 and 29 bias the bearings 26 and 27 toward the left in FIG. 1. The longitudinal motion of the bearings 26 and 27 is provided to accommodate for the spreading of the two rows of containers 12 when the posts 14 and 15 have turned through 45 degrees. Because the continuous band 12*a* has a fixed length, when the square posts 14 and 15 rotate the resulting loop spreading requires that the bearings 26 and 27 move to the right in FIG. 1 by a small amount to accommodate the spreading. By this means the chain of the containers 12 is maintained in a taut condition throughout the motion of containers 12 from the exit opening 11*a* in the housing 11 to the presentation position 22.

Figure 3:
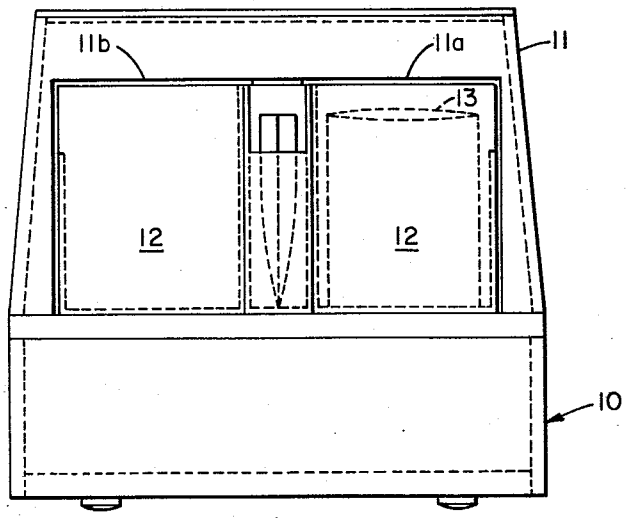
FIG. 3 is a front elevation of the embodiment of FIG. 1.

The operation of the main solenoid 18 which advances the chain of containers 12 is under the control of a programmable timer 30. The timer 30 may be programmed to dispense a medication container 12 at individually preselectable times. With reference to FIG. 3, it can be seen that the containers 12 fill virtually the entire exit opening 11*a* and entrance opening 11*b* in the housing 11 so that when the containers 12 are within the housing, access to the contents of such a container is prevented. Only when a container 12 is in the presentation position 22 can the contents be removed.

To set up the dispensing apparatus 10 for operation, the housing 11 is first removed by the physician, pharmacist or nurse thereby exposing the plurality of containers 12 which are open at their tops. The various medications appropriate for particular times of administration are then loaded into each of the envelopes 13. After the envelopes 13 are loaded with medication, they are then placed in the appropriate container 12 and the housing 11 replaced and locked into position. It is preferred that the containers 12 and envelopes 13 be color coded according to the time of administration so as to facilitate the accurate loading of the envelopes 13 into the containers 12. Such color coding will also reassure the recipient that the proper medication has been dispensed. Even a color blind individual will be able to distinguish the containers and envelopes because of the differences in relative lightness among the various colors selected. The containers 12 may also be notched or otherwise encoded for tactile interpretation for blind recipients. The programmable timer 30 is then programmed to transport serially the containers 12 from the exit opening 11*a* in the housing 11 to the presentation position 22 at the preselected times. For example, a first container 12 might be moved to the presentation position 22 at 8:00 A.M. Accompanying this presentation of medication may be a visible or audible alarm (not shown) to alert the patient that medication is available. The patient removes the medication containing envelope 13 from the container 12, takes the medication and replaces the now empty envelope into the container 12. In this embodiment, the dispenser apparatus 10 will remain quiescent until the next programmed time for dispensing, e.g., 12 o'clock noon. At this time, the next container 12 is rotated from the exit opening 11*a* in the housing 11 to the presentation position 22. Simultaneously, the previously presented container will return to the entrance opening 11*b* within the housing 11. Thus, if the patient failed to take the 8:00 A.M. administration of medicine, the still filled container will be recaptured within the housing 11. When it is necessary to reload the dispenser 10, the fact that an envelope has not been emptied verifies that the patient missed a particular drug administration. The operation just described continues until all of the containers 12 have been transported to the presentation position 22. Thereafter, the dispenser 10 is reloaded for another period of automatic dispensing.

It is noted at this point that the medication dispenser 10 is well adapted for purposes other than the administration of tablets and capsules. For example, an envelope 13 might be loaded with a diagnostic test kit which the patient can use himself. An envelope 13 might contain, for example, a probe used to test urine. When this diagnostic kit is transported to the presentation position 22, the patient removes the probe from the envelope and immerses it in urine. Thereafter, the probe is returned to its envelope and then placed back into the container 12. When the dispenser is next activated, the probe will be returned to an inaccessible position within the device 10. Thereafter, a physician or lab technician is assured of when the urine test was made and can evaluate the tests results. In addition, it is preferred that the envelopes 13 have a space on which the patient may write notes concerning the test procedures followed or other information.

Figure 4:
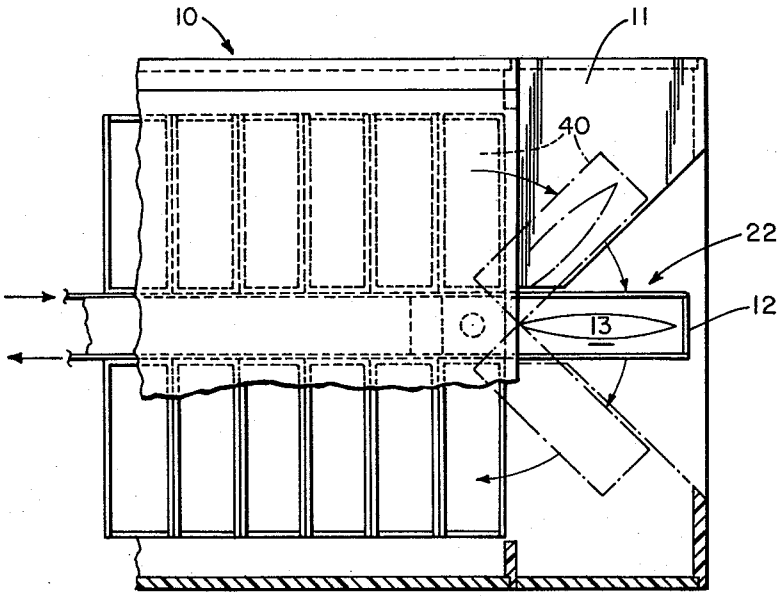
FIG. 4 is a plan view of another embodiment of this invention.

Another important embodiment of this invention is illustrated in FIG. 4. This embodiment incorporates the feature of presenting a medication container for a limited time interval after which the container is rotated to an inaccessible position within the dispenser without thereby causing a second container to be moved to the presentation position 22. In this embodiment the housing 11 extends forwardly from its configuration in FIGS. 1 and 2. The solenoid and ratchet mechanisms of this embodiment (not shown) are adapted for rotating the medication containers 12 through an angle of 45 degrees upon each activation rather than through 90 degrees, as was the case with the embodiment of FIGS. 1 and 2. As illustrated in FIG. 4, a medication container 12 is in the presentation position 22. After an adjustable first time interval or grace period of, e.g., 30 minutes, the container 12 rotates 45 degrees so that it is within the housing 11 rendering its contents unavailable. As indicated, a medication container 40 simultaneously moves from its initial position aligned at a right angle to the long axis of the dispenser 10 to a 45 degree orientation just within the housing 11. At this time there will be no medication container in the presentation position 22. After a second time interval, that is, when it is time for the next period of medication administration, the container 40 will rotate through another 45 degrees so that it moves to the presentation position 22. The container 40 will remain in this position for a grace period which may or may not be the same length of time as the earlier grace period. After this grace period, the container 40 will rotate through 45 degrees again moving it to an inaccessible position within the housing 11. At this time, as before, there will be no container in the presentation position. This process continues until all of the medication containers 12 have been transported to the presentation position 22.

The embodiment illustrated in FIG. 4 helps to assure that the proper dosage is taken at the proper time. If the medication containing envelope 13 is not removed within the grace period allotted, the container 12 will rotate to an inaccessible position so that the medication cannot thereafter be retrieved. Again, this aspect is important for verification of when particular medications were or were not taken. In particular, this aspect of the invention is extremely important when research protocols are being conducted on new drugs, for example.

It is contemplated that several of the medication dispensers disclosed herein will be connected to a central computer system to control individually the times of administration of medication from the various dispensers. Such an arrangement is particularly well suited to a hospital, nursing home or other institutional setting. In this case, the medication dispensers need not have their own programmable timers since activation signals will be supplied by the central computer.

It is thus seen that the objects and advantages of this invention have been achieved in that there has been disclosed an automatic medication dispenser which can dispense a variety of medications at preselectable times and for adjustable intervals. In addition, the medications so dispensed may remain accessible to the patient for but a limited grace period after which time the medication is returned to the interior of the dispenser. This automatic dispenser is also simple to manufacture and extremely reliable. In addition, such a device eliminates many of the difficulties encountered in the dispensing of medications, such as skipped doses, errors in dosages, overdoses, etc.

While this invention has been described with reference to particular embodiments it is recognized that modifications and variations will be apparent to those skilled in the art. It is intended that all such modifications and variations be included within the scope of the claims appended herewith. Although this disclosure has been directed particularly to medication dispensers, it is recognized that the dispensers disclosed herein may be used for dispensing other goods at preselectable times.

What is claimed is:

1. Apparatus for presenting consecutively each of a plurality of containers including the combination of:

a plurality of said containers linked in an endless chain;

stepping means including a timer adapted to move the chain intermittently to advance the containers successively to and from a fixed presentation position; and a housing completely enclosing all of said containers except for the container in said fixed presentation position, said housing including exit and entrance openings adjacent said fixed position, said containers being adapted to close substantially said exit and entrance openings after a container has advanced to and from said fixed presentation position;

wherein the stepping means advances the containers at the end of consecutive alternating first and second time intervals, the containers and openings being spaced so that during each said first interval a container is located in said fixed presentation position and during each said second interval no container is located in said fixed presentation position.

2. The apparatus according to claim 1 in which said first and second time intervals are of unequal duration.

3. The apparatus according to claim 1 wherein said timer is programmable so that said first and second time intervals are independently adjustable.

* * * * *